US007513129B1

(12) United States Patent
Mays

(10) Patent No.: US 7,513,129 B1
(45) Date of Patent: Apr. 7, 2009

(54) JEWELRY STRUCTURE

(76) Inventor: Kimberly M. Mays, 700 Bryson Way, Southlake, TX (US) 76092

( * ) Notice: Subject to any disclaimer, the term of this patent is extended or adjusted under 35 U.S.C. 154(b) by 66 days.

(21) Appl. No.: 11/563,737

(22) Filed: Nov. 28, 2006

Related U.S. Application Data

(60) Provisional application No. 60/740,751, filed on Dec. 1, 2005.

(51) Int. Cl.
*A44C 15/00* (2006.01)

(52) U.S. Cl. ..... 63/3.2; 63/41

(58) Field of Classification Search ..... None
See application file for complete search history.

(56) References Cited

U.S. PATENT DOCUMENTS

D175,510 S * 9/1955 Katz ..... D11/8
D176,678 S * 1/1956 Katz ..... D11/9
D424,976 S * 5/2000 Farfan ..... D11/213

* cited by examiner

*Primary Examiner*—Jack W. Lavinder
(74) *Attorney, Agent, or Firm*—Pearne & Gordon LLP

(57) ABSTRACT

A jewelry structure adapted to hang jewelry elements on both the front and back of a wearer.

14 Claims, 3 Drawing Sheets

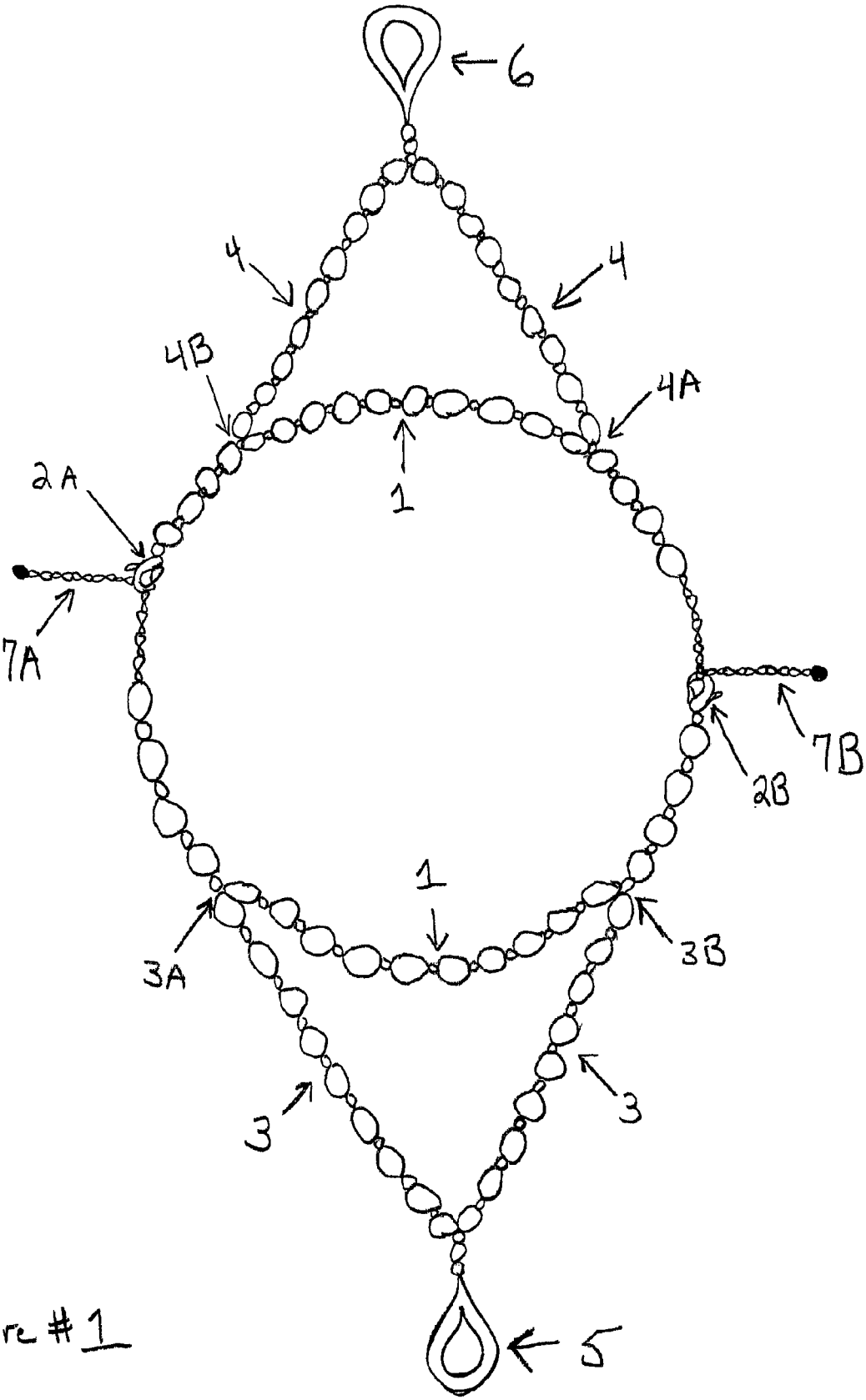
Figure # 1

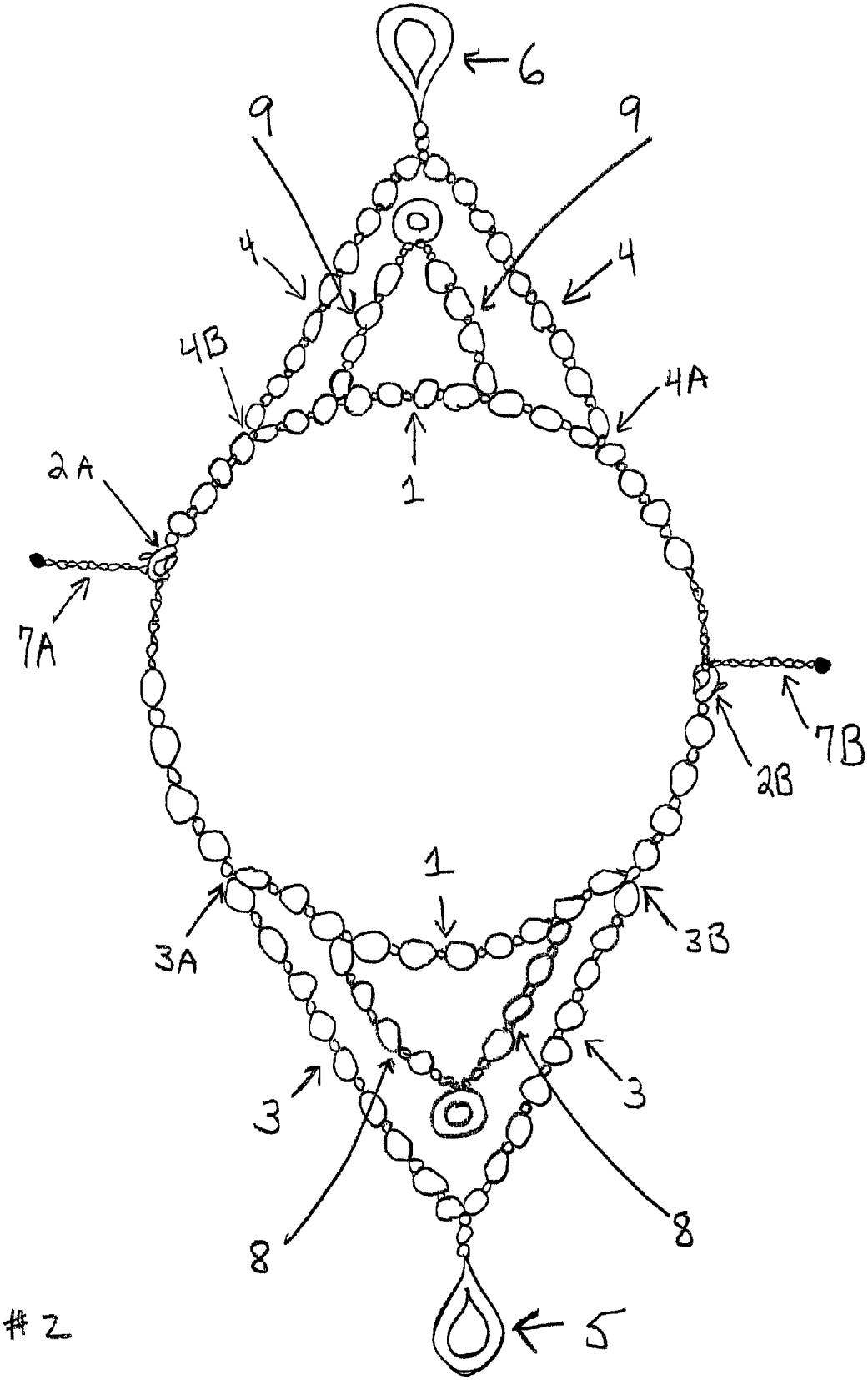
Figure # 2

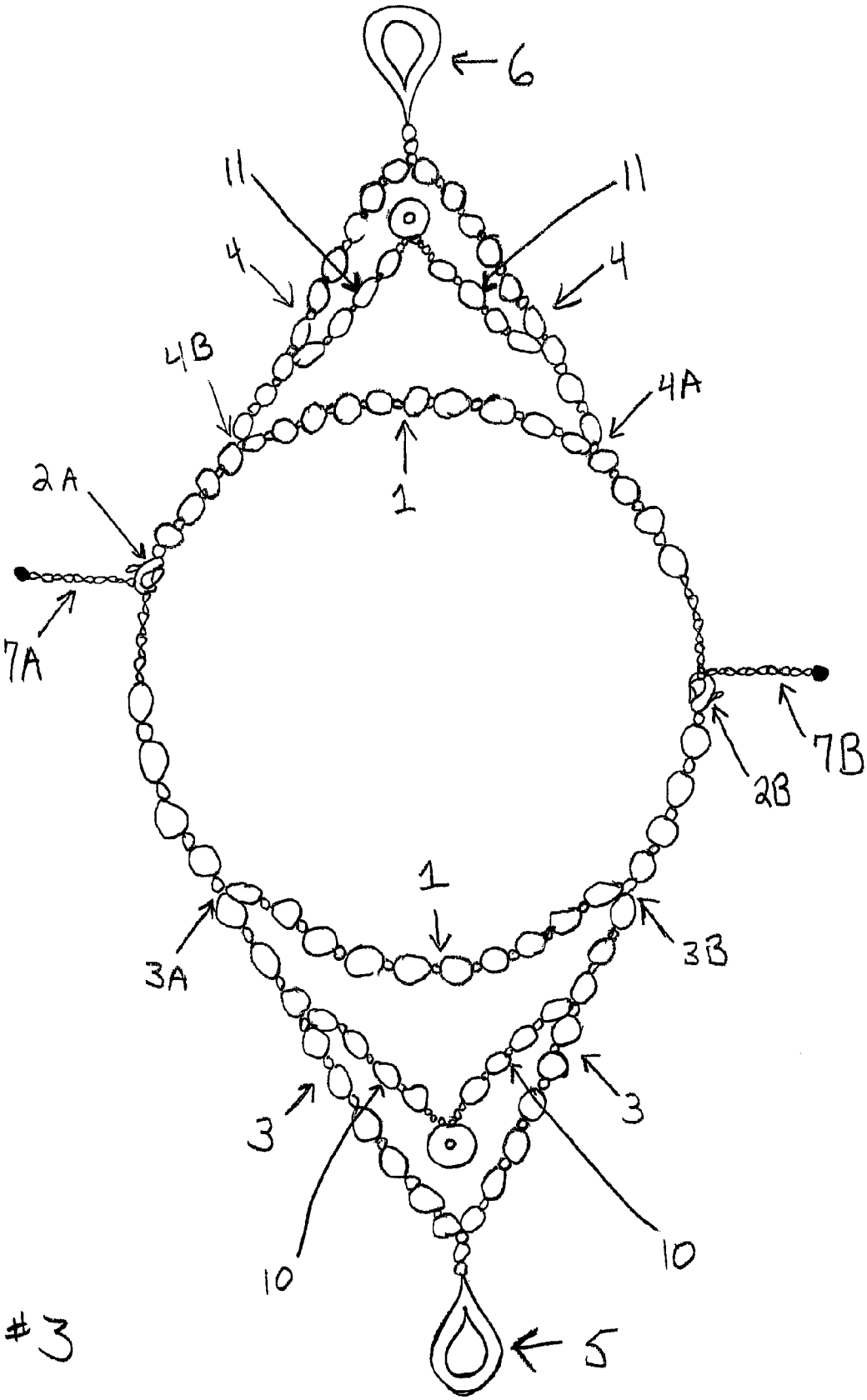
Figure #3

JEWELRY STRUCTURE

CROSS-REFERENCE TO RELATED APPLICATIONS

This application claims the benefit of U.S. Provisional Patent Application No. 60/740,751 filed on Dec. 1, 2005 and is incorporated herein by reference in its entirety.

The invention relates to a jewelry necklace that simultaneously hangs both in the front and back of a wearer.

SUMMARY OF THE INVENTION

In accordance with the invention there is provided a structure adapted to dispose necklace elements on both a front side and back side of a wearer comprising an annular choker loop adapted to be secured around a neck of a wearer, a first elongate necklace element attached to a first side of said annular choker loop and adapted to hang along a front side of said wearer when said choker loop is secured around said neck, and a second elongate necklace element attached to a second side of said annular choker loop substantially opposite said first elongate necklace element and adapted to hang along a back side of said wearer when said choker loop is secured around said neck. In one aspect of the invention the opposed ends of at least one of said first and second elongate necklace elements are each attached to said choker loop, whereby said at least one elongate necklace element forms a first appended necklace loop appended to said choker loop. In another aspect of the invention, opposed ends of each said first and second elongate necklace element are each attached to said choker loop, whereby each said first and second elongate necklace elements forms a respective first and second appended necklace loop appended to said choker loop.

In still further aspects of the invention, said structure includes at least one additional elongate necklace element attached to said choker loop, and/or attached to said first appended necklace loop. Said additional elongate necklace element(s) may have opposed ends attached to said choker loop and/or said elongate necklace elements, whereby said additional necklace element or elements form an additional appended necklace loop appended to said choker loop and/or said additional necklace element or elements.

In some embodiments said choker loop further comprises at least one fastener disposed along its length adapted to reversibly open and close said choker loop and a plurality of removable necklace links adapted to alter the circumference of said choker loop. In other embodiments, said structure may include at least one jewelry piece attached to said at least one of said choker loop, first elongate necklace element or second elongate necklace element.

BRIEF DESCRIPTION OF THE DRAWINGS

FIG. 1 shows a plan view of a jewelry structure according to the invention.

FIG. 2 shows a plan view of another jewelry structure according to the invention.

FIG. 3 shows a plan view of an additional jewelry structure according to the invention.

DETAILED DESCRIPTION OF THE INVENTION

With reference to FIG. 1, the necklace of the invention includes at least one central choker loop 1 which is adapted to be disposed circumferentially around the neck of a wearer. The choker loop 1 includes at least one fastener interposed along its length, whereby said choker loop can be secured around the wearer's neck. As shown in FIG. 1, in some embodiments, the choker loop 1 may include multiple fasteners 2*a*, 2*b*. The choker loop can be any suitable elongate structure and material typically used in the manufacture of jewelry and known to those in the art, such as a chain, ribbon, rope, string, leather thong, wire or the like. The choker loop may itself be made entirely of jewelry grade, electroplated or precious metal, or may comprise an elongate base material onto which jewelry grade, electroplated, precious metal, metal or plastic beads or other elements are strung, secured or otherwise disposed. Similarly, removable necklace links or other structure can be appended to the choker loop or fastener (s) so as to enable the size of the choker loop to be adjusted to the size of the wearer's neck as is known in the art. As shown in FIG. 1, in some embodiments, removable necklace links 7*a*, 7*b* may be disposed at opposing circumferential locations along the choker loop 1.

The necklace further includes at least one additional necklace element 3 attached to a portion of the choker loop 1 adapted to hang in front of a wearer, hereinafter referred to as a front portion of the choker loop 1, and at least one additional necklace element 4 attached to a portion of the choker loop adapted to hang in the back of a wearer, hereinafter referred to as a back portion of said choker loop 1. In this manner, when the choker loop is disposed around the neck of the wearer, said additional necklace elements 3, 4 are disposed in the front and back of the wearer, respectively. Said additional necklace elements 3, 4 may be the same material and structure as each other or different. Likewise, said additional necklace elements 3, 4 may be the same material and structure as said choker loop 1 or different from said choker loop. Thus, the additional necklace elements 3, 4 can be any suitable elongate structure and material typically used in the manufacture of jewelry and known to those in the art, such as a chain, ribbon, rope, string, leather thong, wire or the like. The additional elements 3, 4 may themselves be made entirely of jewelry grade, electroplated or precious metal, or may comprise an elongate base material onto which jewelry grade, electroplated, precious metal, metal or plastic beads or similar elements are strung, secured or otherwise disposed.

Each said additional necklace element 3, 4 may consist of a single elongate element secured at one end to said choker loop with the opposite end hanging free or, as shown in FIG. 1, opposed ends thereof 3*a*, 3*b*/4*a*, 4*b* may each be secured to said choker loop 1 to form an additional necklace loop appended thereto. In further embodiments of the invention, additional necklace elements may be secured to said front and/or back portion of said choker loop 1 or to said necklace elements 3, 4. For example, as shown in FIG. 2, each said front or back portion of said choker loop 1 may include one or more said additional elongate necklace elements 8, 9 either secured, as shown, at opposed ends to said choker loop 1 to form additional necklace loops on the front and/or back portion thereof, or secured at one end to said choker loop 1 to form a free-hanging necklace element or a combination thereof.

Likewise, as shown in FIG. 3, each said necklace element 3, 4 may include one or more said additional necklace elements 10, 11 either secured, as shown, at opposed ends to said necklace elements 3, 4 to form additional necklace loops appended thereto, or secured at one end to said necklace elements 3, 4 to form a free-hanging necklace element or a combination thereof. In addition, one or more of said additional necklace elements may be fixedly attached to said choker loop 1 and/or necklace elements 3, 4 or may be removably attached so as to enable the wearer to alter the configuration of the necklace.

In accordance with the invention, one or more of said necklace elements, including said choker loop 1, may include one or more jewelry pieces 5, 6 attached thereto. There is virtually no limitation as to the types, nature or combinations of jewelry pieces or embellishments which may be attached to the various necklace elements of the invention, and any jewelry pieces or embellishments typically known in the art will be suitable. Such jewelry pieces and embellishments can include, but are not limited to, beads, stones, icons and idols of any suitable material known in the art ranging from precious metals and stones to common metals and plastics. Said jewelry pieces and embellishments may be fixedly or removably secured to and arranged on said necklace elements in any desirable fashion or combination.

These and other aspects of the invention will become apparent to those of ordinary skill in the art in connection with the attached drawings showing exemplary embodiments of the invention.

What is claimed is:

1. A structure adapted to dispose necklace elements on both a front side and a back side of a wearer comprising:

a) an annular choker loop adapted to be secured around a neck of a wearer, said choker loop comprising at least two discontiguous and spaced apart adjusting segments, said adjusting segments comprising structure adapted to alter the circumference of said choker loop distinct from the remaining structure of said choker loop;

b) a first elongate necklace element attached to a first side of said annular choker loop and adapted to hang along a front side of said wearer when said choker loop is secured around said neck;

c) a second elongate necklace element attached to a second side of said annular choker loop substantially opposite said first elongate necklace element and adapted to hang along a back side of said wearer when said choker loop is secured around said neck.

2. A structure according to claim 1 wherein opposed ends of at least one of said first and second elongate necklace elements are each attached to said choker loop, whereby said at least one elongate necklace element forms a first appended necklace loop appended to said choker loop.

3. A structure according to claim 2 wherein opposed ends of each said first and second elongate necklace element are each attached to said choker loop, whereby each said first and second elongate necklace elements forms a respective first and second appended necklace loop appended to said choker loop.

4. A structure according to claim 3 further comprising a first additional elongate necklace element having opposed ends attached to said choker loop on said first side, and a second additional elongate necklace element having opposed ends attached to said choker loop on said second side, whereby said additional necklace elements form additional appended necklace loops appended to said choker loop.

5. A structure according to claim 3 further comprising an additional elongate necklace element attached to each said first and second appended necklace loops.

6. A structure according to claim 5 wherein opposed ends of each said additional elongate necklace element are each respectively attached to said first and second appended necklace loops, whereby said additional necklace elements each form additional appended necklace loops appended to said first and second appended necklace loops.

7. A structure according to claim 3 further comprising at least one jewelry piece attached to each said first and second appended necklace loops.

8. A structure according to claim 2 further comprising at least one additional elongate necklace element attached to said first appended necklace loop.

9. A structure according to claim 8 wherein opposed ends of said at least one additional necklace element are each attached to said first appended necklace loop, whereby said additional necklace element forms an additional appended necklace loop appended said first appended necklace loop.

10. A structure according to claim 2 further comprising at least one additional elongate necklace element having opposed ends attached to said choker loop, whereby said additional necklace element forms an additional appended necklace loop appended to said choker loop.

11. A structure according to claim 2 further comprising at least one jewelry piece attached to said first appended necklace loop.

12. A structure according to claim 1 further comprising at least one additional elongate necklace element attached to said choker loop.

13. A structure according to claim 1 wherein said choker loop further comprises at least one fastener disposed along its length adapted to reversibly open and close said choker loop and wherein at least one of said adjusting segments comprises a plurality of removable necklace links adapted to alter the circumference of said choker loop.

14. A structure according to claim 1 further comprising at least one jewelry piece attached to at least one of said choker loop, first elongate necklace element or second elongate necklace element.

* * * * *